US005628338A

United States Patent [19]

Stumbo

[11] Patent Number: 5,628,338

[45] Date of Patent: May 13, 1997

[54] COLLAPSIBLE BLIND

[76] Inventor: Steven W. Stumbo, P.O. Box 1270, LaPorte, Colo. 80535

[21] Appl. No.: 639,848

[22] Filed: Apr. 19, 1996

[51] Int. Cl.[6] ..... E04H 15/48

[52] U.S. Cl. ..... 135/147; 135/153; 135/901

[58] Field of Search ..... 135/135, 147, 135/148, 151, 157, 153, 159, 901, 900, 902

[56] References Cited

U.S. PATENT DOCUMENTS

| | | | |
|---|---|---|---|
| 3,105,505 | 10/1963 | Maybee . | |
| 3,625,235 | 12/1971 | Gorgichuk . | |
| 3,810,482 | 5/1974 | Beavers | 135/147 |
| 3,941,140 | 3/1976 | Beavers . | |
| 3,968,809 | 7/1976 | Beavers . | |
| 4,026,312 | 5/1977 | Beavers . | |
| 4,067,346 | 1/1978 | Husted | 135/153 |
| 4,265,261 | 5/1981 | Barker | 135/116 X |
| 4,819,680 | 4/1989 | Beavers . | |
| 5,069,572 | 12/1991 | Niksic | 135/147 X |
| 5,423,341 | 6/1995 | Brady | 135/147 X |

FOREIGN PATENT DOCUMENTS

| | | | |
|---|---|---|---|
| 0028986 | 3/1979 | Australia | 135/147 |

*Primary Examiner*—Lanna Mai
*Attorney, Agent, or Firm*—Dean P. Edmundson

[57] ABSTRACT

A portable and collapsible blind or shelter which includes an integral fabric cover having four side walls and a top. Each side wall includes at least one window. One corner of the structure includes a vertical opening to permit ingress and egress from the structure. Each side wall, and the top, is supported in a taut condition by a support member having four resilient and flexible legs connected to a central hub. The perimeter of each side wall and the top is non-stretchable. The legs can pivot away from the hub to collapse the blind structure.

9 Claims, 3 Drawing Sheets

COLLAPSIBLE BLIND

FIELD OF THE INVENTION

This invention relates to portable and collapsible shelters for use by sportsmen. More particularly, this invention relates to portable and collapsible blinds for use by hunters, photographers, etc.

BACKGROUND OF THE INVENTION

Hunters, photographers, bird watchers, etc. often desire or have a need to remain hidden from view of wildlife they are observing or pursuing. Although permanent blinds or shelters have been used for this purpose, the lack of portability of the structures is a significant disadvantage.

Portable tents and similar shelters have been available for a long time and they can also be used as blinds. However, some of such structures are difficult or cumbersome to carry and set up when needed. Other of such structures are not suitable as blinds. For example, U.S. Pat. No. 4,819,680 describes a ground tent having four sides and a top, with a plurality of poles having a spring-biased foot subassembly supporting a fabric cover. Such a structure is not practical for use as a blind and it is time-consuming to set up when needed.

U.S. Pat. No. 3,105,505 describes a portable and collapsible tent having four walls, a floor and a domed ceiling. This structure is not suitable for use as a blind.

U.S. Pat. Nos. 4,026,312 and 3,941,140 describe a foldable free-standing tent having ends walls, a floor, and side walls which slope upwardly to a peak. This structure is cumbersome to set up and is not suitable as a blind.

U.S. Pat. No. 3,625,235 describes a portable shelter which is sphere-shaped and requires several supporting poles or rods. It is cumbersome to set up and take down and would not be suitable for use as a blind in the field.

U.S. Pat. No. 3,968,809 describes a van tent, i.e., a tent-like extension for attachment to the rear of a van. This structure is useful as a shelter for workmen who require easy access to their van for tools and materials and who do not desire to go out into the elements while working. This structure is not at all suitable as a temporary blind in the field because it requires a van to support it.

There has not heretofore been provided a light-weight portable, easily collapsible blind or shelter having the combined features of the present invention.

SUMMARY OF THE PRESENT INVENTION

In accordance with the present invention there is provided a portable, collapsible shelter or blind structure which is extremely useful for use by hunters, photographers and nature observers who desire to remain hidden in the field. In a preferred embodiment the structure comprises:

(a) a flexible fabric cover having four sides and a top; wherein each side includes at least one window opening; and (b) a framework comprising five support members; wherein each support member comprises four resilient rods connected at one end to a central hub; wherein the rods extend radially outward from the hub and are spaced generally equidistantly around the hub.

The perimeter of the fabric cover must be non-elastic and non-stretchable. This may be accomplished by incorporating a non-stretchable cord (or stitching) into the fabric along the perimeter of each side of each side wall and top section.

Each support member is adapted to hold one side or wall of the structure in a taut condition, with each rod extending from the central hub to one corner of the wall or side. The distance from the end of one rod to the end of a diametrically opposite rod on the same hub is slightly greater than the distance from one corner of a wall to the diametrically opposite corner of the same wall. This enables the support member to be urged to an over-center position where the rods are slightly bowed outwardly and the tension of the wall fabric holds the support member in a taut and bowed condition. A similar support member is also used to hold the ceiling in a taut condition.

An openable doorway is positioned vertically at one corner of the blind or shelter to enable ingress and egress. Closure means such as a zipper is used to close the opening.

There is no need for a floor in the blind.

The blind or shelter is self-contained and can be quickly and easily collapsed for easy transport. It can also be set up very quickly and easily with a minimum of time.

Other advantages of the blind or shelter of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
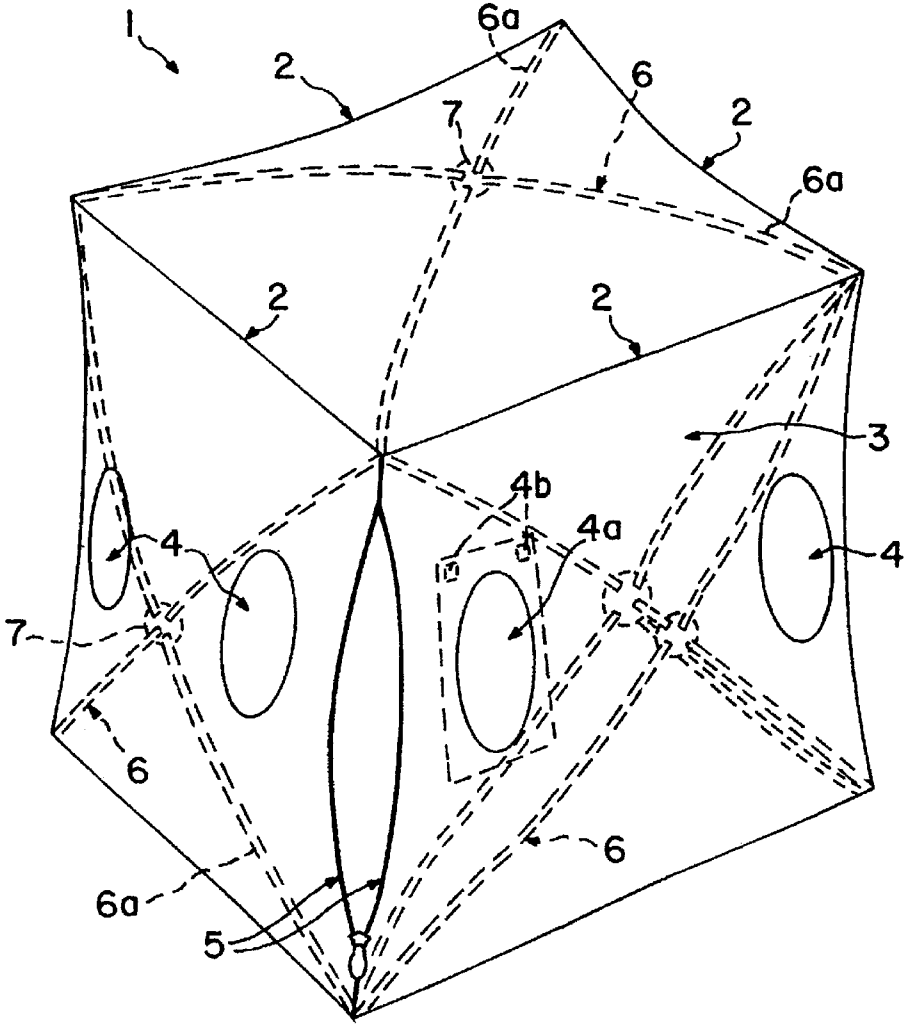
FIG. 1 is a perspective view of a preferred embodiment of a portable, collapsible blind of the invention.
Figure 2:
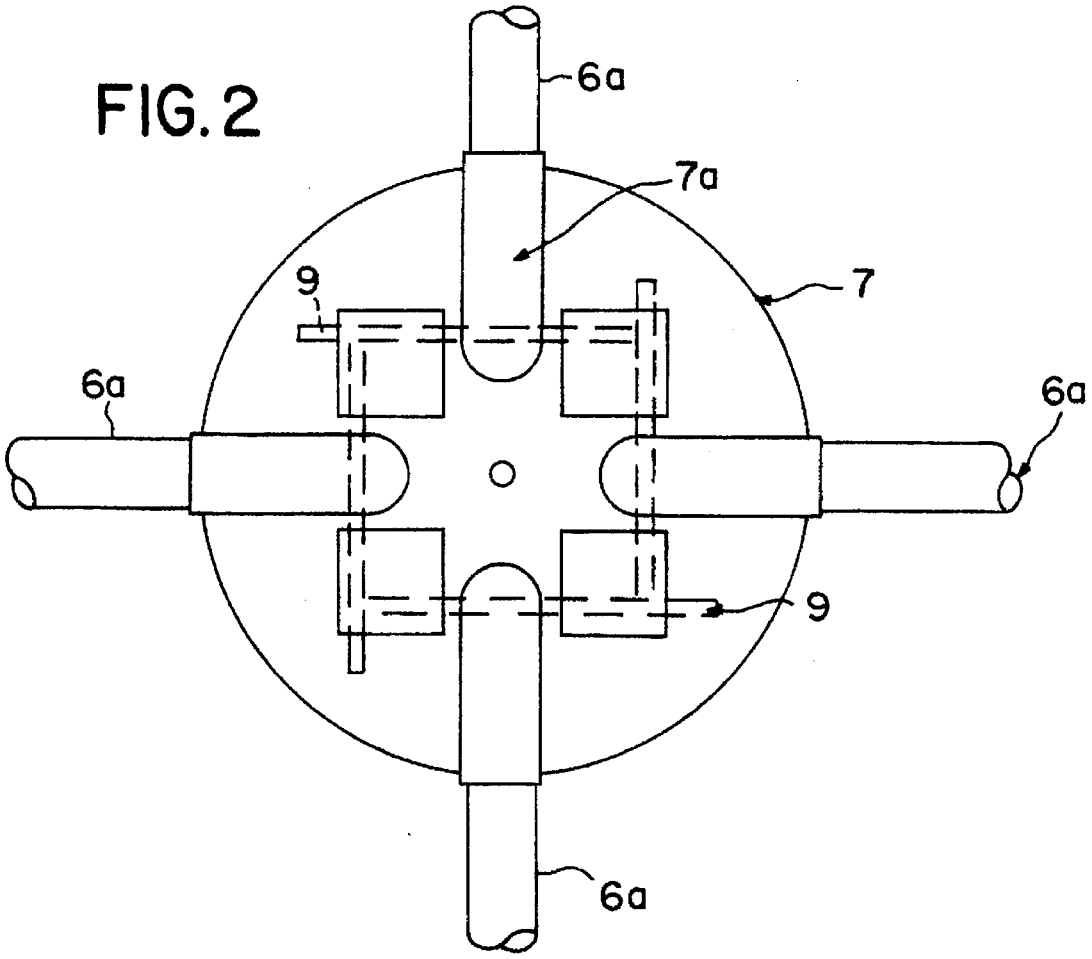
FIG. 2 is an elevational view of a preferred embodiment of pole and hub structure useful in the invention.

In the drawings there is shown a portable, collapsible blind or shelter 1 of the invention. The blind comprises an integral fabric cover 3 having four side walls and a ceiling or roof whose side edges are securely attached or sewn to the upper edges 2 of the side walls.

Preferably the side walls are generally square. The ceiling or top section is also preferably square.

Figure 4:
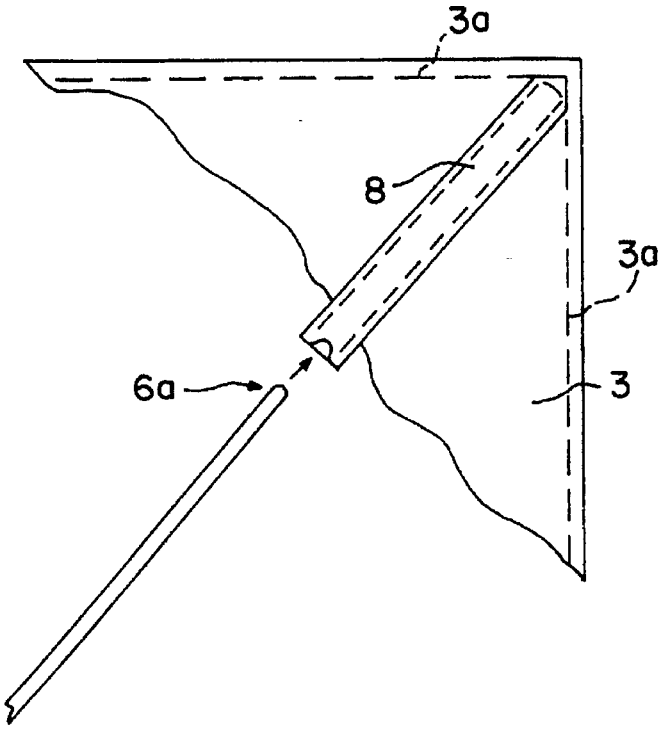
FIG. 4 is an elevational view showing an inside corner of the blind structure.
Figure 5:
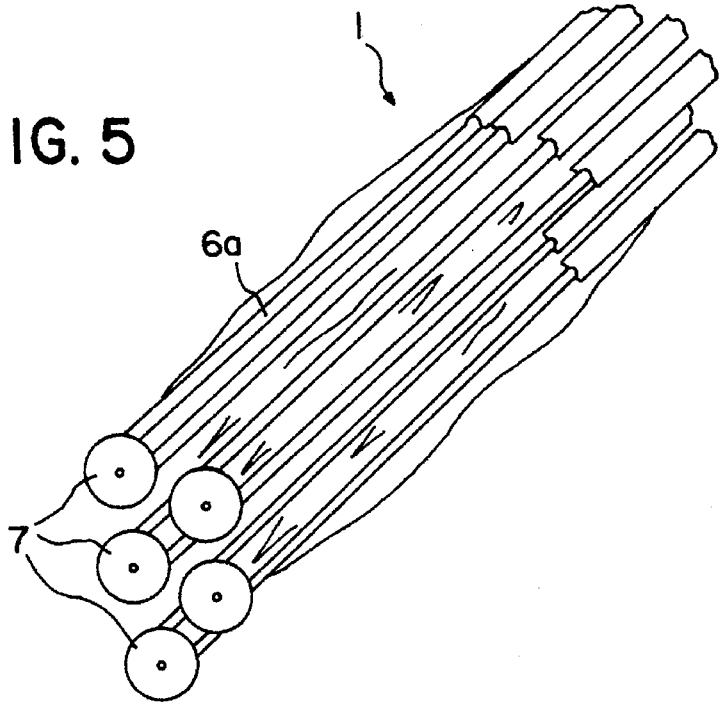
FIG. 5 shows the blind of FIG. 1 in its collapsed position for storage or transport.

Each side wall, and the ceiling, is supported or held in a taut condition by means of a support member 6. Each support member comprises four resilient legs or rods 6A whose inner ends are pivotably or hingedly attached to a central hub 7. Preferably the legs or rods are of the same length (when the walls are square). The outer end of each rod or leg is slidably received in a sleeve or pocket 8 sewn or secured to the wall fabric at each corner (as shown in FIG. 4).

A non-stretchable string or cord 3A must be sewn along each side edge of each wall section and also along each side edge of the top section. Alternatively, it is possible to use non-stretchable thread to stitch around the perimeter of each side wall section and also the perimeter of the top section.

Each wall includes at least one window 4 to enable viewing through the wall by a person positioned inside the blind. Preferably each window includes a flap or cover 4A which can be opened to enable viewing through the window. One such cover 4A is shown in FIG. 1, but preferably each window includes this feature. The cover or slap 4A can be secured, for example, along its bottom edge to the side wall (e.g., by stitching) and can be held in a closed position over the window by hook and loop fasteners 4B or other suitable fasteners (e.g., buttons, snaps, etc.).

Figure 3:
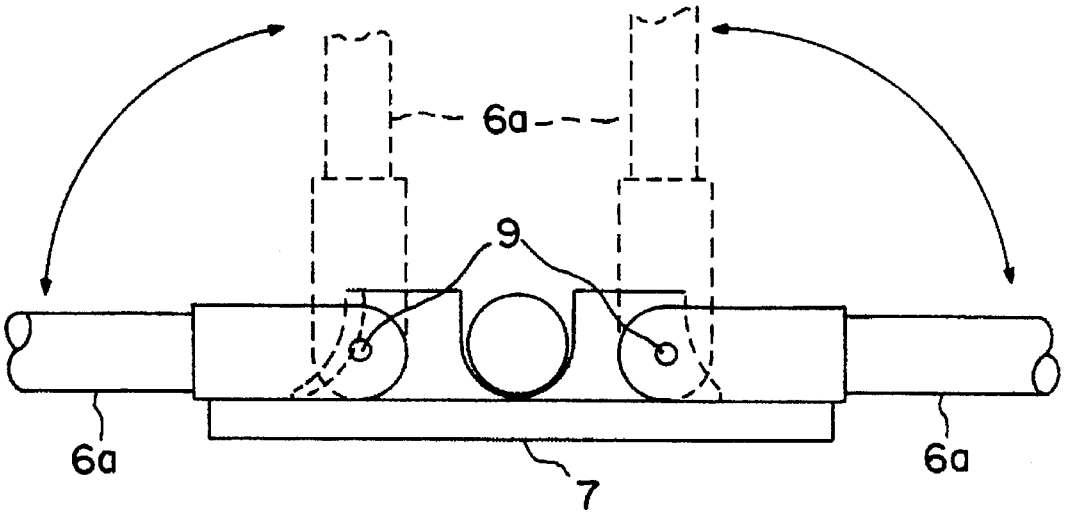
FIG. 3 is a side elevational view of the pole and hub structure shown in FIG. 2.

The rods 6A are resilient and flexible and their inner ends are secured in tubular receivers 7A on hub 7. Each receiver is hinged to the hub by a pin 9. As shown in FIG. 3, the receivers 7A can pivot through an angle of 90° from a position parallel to the plane of the hub to a folded position (as shown in dotted lines in FIG. 3). Thus, the hub prevents the receivers, and therefore the legs 6A, from pivoting past the plane of the hub.

One way of making the blind structure is to make four side wall sections and a top section and then stitch abutting side wall edges together. The side edges of the top section can then be stitched to the top edge of each side wall section. By using non-stretchable thread, or by incorporating or non-stretchable cord or string into all edges of each section, the wall sections and the top section are prevented from stretching when the support members are inserted. Then when the support members are urged to their outwardly bowed condition, the tautness of the cover tends to maintain the support members in the desired over-center condition to support the blind in an upright position.

A zipper is incorporated in one corner of the structure where two side walls meet. The zipper is stitched in place with non-stretchable thread. The leg members must flex in order to enable the door opening to expand for ingress and egress. When the zipper is in an open position, the fabric adjacent the opening can be pulled slightly away from the opening (which results in widening of the opening as the pegs flex).

As illustrated in the drawings, the blind is set up by first positioning the legs of each support member in a respective sleeve or pocket at one of the corners of a wall section. The same procedure is used with respect to the support member for the ceiling or top section. Then the hub of each support member is pushed outwardly toward the wall to force the hub through a center position to an over-center position. The same procedure is used with respect to the ceiling or top. FIG. 1 illustrates one of the support members prior to passing through dead center to the outwardly bowed over-center position.

The size of the blind may vary, as desired. The legs or rod members may also vary in size. Preferably the legs are comprised of fiberglass or other material which is resilient and flexible and capable of holding the fabric in a taut condition when the support member is forced into a bowed condition, as shown in the drawings.

The blind structure of the invention is fully self-supporting and does not require stakes or other components in order to be held in an upright condition. The structure is erected or set up by one person very rapidly leaving the person inside the structure when the sides and top are popped into their expanded form or condition. Although stakes can be used to stabilize the structure in windy conditions, for normal use it is not necessary to use stakes because the structure is self-supporting and stable.

What is claimed is:

1. A portable and collapsible blind or shelter structure comprising:

(a) a flexible fabric cover having four side walls and a top; wherein each side wall includes at least one window opening; wherein each said side wall includes opposite side edges and a top edge; wherein side edges of adjacent side walls are integral with each other; and further including a closable vertical opening along one of said side edges; wherein the perimeter of each side wall and the top is non-stretchable; and (b) a framework comprising five support members; wherein each said support member comprises four resilient leg members hingedly connected at one end to a central hub; wherein one said support member engages and supports a respective side wall in a taut condition; wherein one said support member engages and supports said top; and wherein said leg members connected to each said hub can be pivoted towards each other to collapse said structure.

2. A structure in accordance with claim 1, wherein each side wall is generally square.

3. A structure in accordance with claim 1, wherein each said side wall includes four corners; and further comprising a pocket secured in each said corner for slidably receiving one of said leg members.

4. A structure in accordance with claim 1, further comprising a flap covering each said window; wherein said flap is movable between open and closed positions.

5. A structure in accordance with claim 1, wherein said vertical opening includes a zipper.

6. A structure in accordance with claim 1, wherein said leg members extend outwardly from said central hub at 90° relative to each other.

7. A portable and collapsible blind or shelter structure comprising:

(a) a flexible, integral fabric cover having four generally-square side walls and a top; wherein each side wall includes at least one window opening; and further including a closable vertical opening along one vertical corner of said structure; wherein the perimeter of each side wall and th etop is non-stretchable; and (b) framework comprising five support members; wherein each said support member comprises four resilient leg members hingedly connected at one end to a central hub; wherein one said support member engages and supports a respective side wall in a taut condition; wherein one said support member engages and supports said top; and wherein said leg members connected to each said hub can be pivoted towards each other to collapse said structure.

8. A structure in accordance with claim 7, wherein each said side wall includes four corners; and further comprising a pocket secured in each said corner for slidably receiving one of said leg members.

9. A structure in accordance with claim 7, further comprising a flap covering each said window; wherein said flap is movable between open and closed positions; and wherein said vertical opening includes a zipper.

* * * * *